United States Patent [19]

Barresi

[11] 4,312,246

[45] Jan. 26, 1982

[54] DUAL OPERATING SYSTEM FOR CONTROLLING A BRAKE OR THE LIKE, INCLUDING A COUNTER SYSTEM TO PREVENT OR REVERSE OPERATION

[76] Inventor: Zina V. Barresi, 900 Old Medford Ave., Medford, N.Y. 11763

[21] Appl. No.: 106,546

[22] Filed: Dec. 26, 1979

[51] Int. Cl.[3] ..... G05G 1/16; G05G 11/00

[52] U.S. Cl. ..... 74/562.5; 74/512; 74/479; 180/322

[58] Field of Search ..... 74/562.5, 512, 479, 74/480 R; 180/272, 322, 325

[56] References Cited

U.S. PATENT DOCUMENTS

| | | | |
|---|---|---|---|
| 2,599,376 | 6/1972 | Ehrenberg | 74/562.5 |
| 2,625,051 | 1/1953 | Kriseman | 74/562.5 |
| 2,694,946 | 11/1954 | Vandal | 74/562.5 |
| 2,953,036 | 9/1960 | Wendt | 74/481 |
| 3,807,253 | 4/1974 | Bellile et al. | 74/512 |
| 3,943,795 | 3/1976 | Kenney | 74/562.5 |

*Primary Examiner*—Kenneth Dorner
*Attorney, Agent, or Firm*—Posnack, Roberts, Cohen & Spiecens

[57] ABSTRACT

An educational vehicle is provided in which the driver-student is provided with a conventional braking pedal and the passenger-teacher is provided with a braking pedal to override the driver-student braking pedal in order to effect a braking operation. Furthermore, there is provided a counter braking pedal which is employed to override the operation of the brake by the driver-student. The counter braking arrangement may involve a mechanical system provided with a mechanical advantage so constructed and arranged that the operation of the counter braking device is capable of preventing or reversing the operation of the brake by the driver-student.

The counter braking operation can also be effected through an electrical or hydraulic apparatus or the like.

16 Claims, 12 Drawing Figures

DUAL OPERATING SYSTEM FOR CONTROLLING A BRAKE OR THE LIKE, INCLUDING A COUNTER SYSTEM TO PREVENT OR REVERSE OPERATION

FIELD OF INVENTION

This invention relates to dual operating systems, and, more particularly, to dual operating systems for controlling the braking systems of educational driving vehicles or the like.

BACKGROUND

Various systems are known for dual operation of functional systems such as braking systems, acceleration systems, clutching systems, and so forth. One particular application of dual operator systems is for the control of braking systems in educational driving vehicles in which a passenger-teacher instructs a driver-student to drive, and in which, for safety's sake, provision is made for overriding the driver-student operation of the braking system in order to prevent accidents.

Sometimes students will panic and freeze on the brake, and the instructor may have a try to insert his foot under his auxiliary brake pedal to try to reverse the braking operation. This is awkward and time consuming and thus dangerous.

Dual braking mechanisms for motor vehicles are shown by way of example in U.S. Pat. Nos. 2,395,280; 2,406,261; 2,512,878; 2,599,376; 2,694,946; 2,710,547; 3,075,602; 3,313,110; 3,319,487; 3,477,310; and 3,943,795.

Although none of these patents disclose a type of system as will be discussed hereinunder, they do disclose systems wherein a braking apparatus in a vehicle can be operated selectively by a student or instructor, or by a driver or his passenger.

For example, J. D. Vandal, in U.S. Pat. No. 2,694,946, discloses a system wherein braking pedals are connected by means of an intermediate rod. One of the braking pedals is connected by a lever to the braking apparatus, whereas the other pedal operates through the rod to operate the first said pedal in order to operate the braking apparatus. This system, however, fails to disclose a braking override whereby the driver's pedal may be prevented from operating, or, on occasions, even reversed in operation.

G. von Rohr, in U.S. Pat. No. 3,313,110, describes a system in which an auxiliary set-up is employed to operate by means of a hydraulic system and appropriate cylinder and piston combinations to operate the driver's clutch pedal and braking pedal. This system is deficient, however, in the respects noted hereinabove with respect to the Vandal patent.

Similarly, S. A. Garcia, in U.S. Pat. No. 3,477,310, discloses an auxiliary system which operates through a flexible cable to operate a braking pedal associated with the driver of the vehicle. This system also fails to provide the type of override which is contemplated within the scope of the present invention.

Frank T. Kenney, in U.S. Pat. No. 3,943,795, discloses a system wherein an auxiliary pedal is supported on a rod through which connection is made to the driver's pedal for purposes of alternate operation of the vehicle brakes when either the driver's pedal or the auxiliary foot pedal is depressed. This system likewise fails to provide for a braking override as mentioned hereinbefore.

SUMMARY OF INVENTION

It is an object of the invention to provide an improved dual operating system.

It is another object of the invention to provide an improved dual operating system in which an override is provided to one of the operators in order to prevent operation by the other of the operators.

It is still another object of the invention to provide an improved arrangement by which a passenger-teacher may instruct a driver-student to operate a vehicle while, at the same time, providing for improved safety of operation of the vehicle.

Yet another object of the invention is to provide an improved mechanical system susceptible of being detachably installed in a vehicle to provide the aforenoted advantages of operation control.

Another object of the invention relates to the providing of sufficient mechanical advantage to enable the overriding of the control by one operator by the operation of the system by another operator to prevent or reverse operation.

In achieving the above and other objects of the invention, there is provided in accordance therewith a utility apparatus comprising at least one function means, first and second control means to control the operation of said function means respectively by first and second operators, and counter control means available to one of the said operators to prevent the operation of said function means by the other of said operators.

According to a preferred embodiment of the invention, the second control means is coupled to said function means through the intermediary of the first control means. Furthermore, said counter control means may include mechanical means to prevent operation of said function means by the other of the operators. As an alternative to the aforegoing, the counter control means may include hydraulic means to prevent the operation of the function means by the other of the operators, thereby substituting hydraulic means for the mechanical means or permitting the same to operate in cooperation with one another. Furthermore, the invention includes the possibility of employing electric means in the aforegoing combination either in cooperation with the mechanical and hydraulic means or in substitution thereof.

In accordance with one specific embodiment of the invention, there is provided in a system having first and second controls selectively displaceable to effect a control operation and a connecting member interconnecting the controls whereby selective displacement of the second control is effective to displace the first control to effect the control operation, a counter control comprising a support and a lever on said support to engage said connecting member and prevent displacement of said first control thereby to prevent said control operation.

In accordance with one aspect of the invention, the lever mentioned above is so constructed and arranged as to provide a mechanical advantage to enable reversing displacement of the first control. Moreover, a member may be pivoted to the aforesaid lever and provided with a slot in which the connecting member is engaged. In this specific embodiment, the connecting member may be a rod, and said controls may include pedals connected to the rod at spaced positions, both of which are closer to the second control than to the first control.

Additionally, in this specific embodiment of the invention, the support may include connected relatively extensible parts whereby the support can be detachably jammed into position for the support of the aforementioned lever without permanent connection to the related system so that no damage need be done to the system when the counter control of the invention is installed. For this purpose, there may be provided, for example, a fixed claw whereby provision is made for grasping onto the system in which installation is to be made. In addition to the above, the controls may be so connected and arranged that operation of the first or second controls mentioned above cocks said counter control for operation thereof.

Viewed from another aspect and in accordance with a particular embodiment of the invention, there is provided an educational driving vehicle with which a passenger-teacher instructs a driver-student to drive, said vehicle comprising driver-student braking means, passenger-teacher braking means to override the driver-student braking means to effect a braking of said vehicle, and counter braking means positioned for operation by the passenger-teacher to prevent or reverse the operation of the driver-student braking means by the driver-student.

In accordance with the latter aspect of the invention, the passenger-teacher braking means and the counter braking means comprise adjacent pedals spaced from but coupled to the driver-student braking means. Moreover, the driver-student braking means may include a pedal coupled to the pedal of the passenger-teacher braking means.

In accordance with a specific embodiment of the invention, a support and a rod extending from said support are provided in the system, the pedal of said passenger-teacher braking means being coupled to said rod, the pedal of said driver-student braking means being coupled to said rod at a position further from said support than where the pedal of said passenger-teacher braking means is coupled to said rod, both said passenger-teacher braking means and driver-student braking means being adapted to deflect said rod in substantially the same direction.

In a particularly advantageous aspect of the invention, the counter braking means is detachably coupled to said rod and is adapted to deflect the rod in a direction generally opposite to the first said direction mentioned above. Moreover, the counter braking means may include means to fix the counter braking means in the vehicle by detachably bracing the same within the vehicle.

The counter braking means may include a member provided with a slot in which to engage the aforesaid rod. The counter braking means may also include a lever coupling the pedal of the counter braking means to said member. Furthermore, the counter braking means may include a pivot supporting the lever in such a manner as to provide a mechanical advantage to the pedal coupled to the lever.

In another particularly advantageous arrangement, the member engages the rod at a position relative to said support such that the pedal of the driver-student braking means has a mechanical advantage which is less than that provided by said lever to said counter braking means.

For the installation of the counter braking means of the invention, there may be provided a rigid structure including threadably extensible foot means. Also, there may be provided a spring means for spring loading the rod to a normal position of rest.

The driver-student braking means and counter braking means may be so constructed and arranged as to have opposing mechanical advantages, the mechanical advantage of the counter braking means exceeding that of the driver-student braking means. The driver-student braking means and counter braking means may be so constructed and arranged that a force exerted on the counter braking means will readily overcome an equal force on the driver-student braking means.

The above objects, features, and advantages of the invention will be found in greater detail in the description which follows hereinafter as illustrated in the accompanying drawing.

BRIEF DESCRIPTION OF DRAWING IN THE DRAWING

FIG. 1 is a fragmentary view of an educational driving vehicle, illustrating an installation of a counter braking means in accordance with a preferred embodiment of the invention;

FIGS. 2A, B, and C respectively illustrate the operation of the braking system of the invention in conjunction with the counter braking installation thereof;

DETAILED DESCRIPTION

In the following, a disclosure will be made of a dual operator system in which one operator may not only override the operation of control by another operator, but in which, as well, operation by one operator can be prevented and even reversed by the other operator.

While such a system will be described with reference to an educational driving vehicle and the braking apparatus thereof, it is to be undersood that the system is also applicable not only to educational driving vehicles but to aircraft, earth-moving equipment, and various other types of apparatus susceptible of being controlled by a multiplicity of operators. It will also be noted that while the instant disclosure is directed principally to a driver-student and passenger-teacher type of relationship, it is possible that the invention can be applied as between two operators, neither of which bears a teacher or student relationship to the other.

In addition to the above, it will be seen below that the invention is shown as being principally applied to a braking system. The invention may as well, however, be readily applied to clutching systems and other types of functional systems which may be similar or not to braking systems involving controls by pedals or other types of manipulative apparatus, be they mechanical, hydraulic, electrical, magnetic, or the like.

Figure 1:
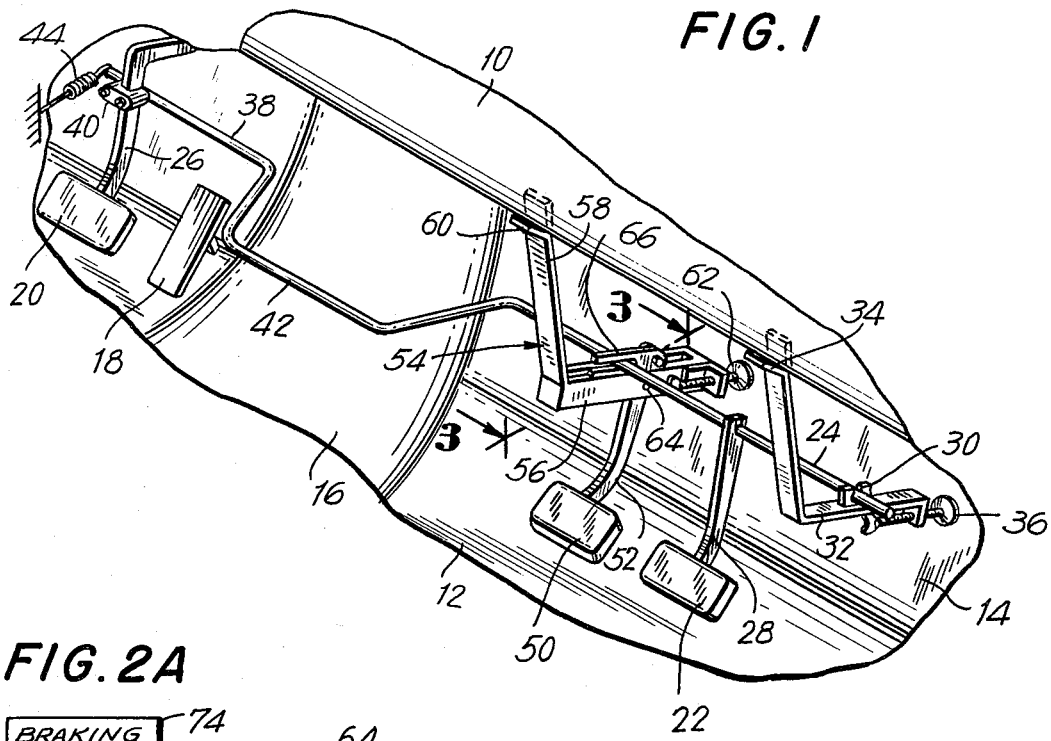

In FIG. 1 is shown a fragmentary portion of the interior front part of an educational driving vehicle. The portion disclosed includes a dashboard 10, a floor 12, a fire wall 14, and a centrally located hump 16, which is intended for the purpose of accommodating a longitudinally aligned shaft (not shown).

As in any conventional vehicle, there is provided a gas pedal 18 and brake pedal 20 located in proximity of a steering wheel (not shown).

As is also conventional in educational driving vehicles, there is provided a passenger-teacher braking pedal 22, the purpose of which is to enable the passenger-teacher to provide a braking operation in the event that the driver-student fails to apply the same, especially with respect to emergency situations in which the driver-student fails to operate or function in timely fashion thereby creating an emergency. As has been described hereinabove, there are a number of systems in which the pedals 20 and 22 are coupled collectively for respective operation by a student and teacher to a braking system of known construction. The braking construction which actually brakes the vehicle requires no discussion in this text and a wide variety of such braking systems are well known and are disclosed in great detail elsewhere.

In the specific driver-student and passenger-teacher arrangement illustrated, the pedal 22 is connected to a rod 24 in fixed manner so that operation of the pedal 22 will function through a lever 26 to operate the braking system which is also controlled by the pedal 20. For this purpose, pedal 22 is provided with a lever 28 connected to the rod 24 in fixed manner. The one end of the rod 24 is connected in a support 30 which permits both rotational and flexural movement of the rod 24 as will be described in greater detail hereinafter. The support 30 is connected into the vehicle or system by means of a rigid structure 32 constituting a brace having thereon a fixed claw 34 and an extensible foot 36, the purpose of which is to permit the brace 32 to be jammed into position in such a manner that it is fixed relative to the vehicle while not being permanently connected thereto. This arrangement permits the installation of the support 30 without doing any permanent damage to the vehicle as might be caused by welding or riveting or installation by the use of metal penetrating screws and bolts as is usually the case.

The other end of the rod 24 indicated at 38 is connected by a clamp 40 to the lever 26, the pivotal axis of which is not shown but is displaced from and different from the pivotal axis of the end of rod 24 in support 30 as will subsequently become obvious. It will be noted further that the rod 24 is provided with a crank section 42 which functions merely to permit passage of the rod past the hump 16, thereby accommodating the hump 16 without interference with operation of the system.

In addition to the aforesaid, a spring 44 sometimes is provided which is connected to the end 38 of rod 24 and connects the same to a fixed portion of the vehicle (not shown) which may, for example, be on the post supporting the steering wheel. The function of the spring 44 is to urge the rod 24 to a normal position of rest.

In further accordance with the invention, there is provided a pedal 50 constituting a major element in the counter braking system which is installed in accordance with the invention. This pedal 50 is connected to a lever 52 supported on a rigid bracing system 54 (which can be extensible), consisting of channel 56 and arm 58. Arm 58 is provided with a fixed jaw 60, the purpose of which is to engage on the underside of the dashboard 10, thereby operating in conjunction with an extensible foot 62 to jam the bracing structure into position thereby to support the pedal 50 and lever 52 on a pivot pin indicated at 64.

Connected to the lever 52, as will be discussed in greater detail hereinafter, is a member 66 which is a slotted member provided with a slot in which is engaged the rod 24. As will be explained in greater detail hereinafter, operation of the pedal 22 will cock the pedal 50 for operation, and operation of the pedal 50 will enable braking motion of the rod 24 as imparted through lever 26 to be prevented and even reversed due to the mechanical advantages of the system which are so arranged that the operation of pedal 50 may overcome or override operation of the pedal 20. As a consequence, it will be possible for the passenger-teacher to overcome and prevent or reverse operation of the braking system by the driver system, thereby providing many of the various benefits of the invention and materially improving the safety conditions which exist in educational driving instruction.

Various of the elements described hereinabove appear in FIGS. 2A,B, and C. Thus, for example, these figures illustrate pedal 20, pedal 22, and pedal 50. Also indicated in these figures are the pivot 64 of lever 52 with the relative lever arms, being indicated, for example, at 70 and 72 and being such as to permit sufficient mechanical advantage whereby other mechanical advantages inuring to the benefit of pedal 20 may be overcome to prevent or reverse operation of the braking apparatus which is indicated diagrammatically at 74.

Figure 2A:
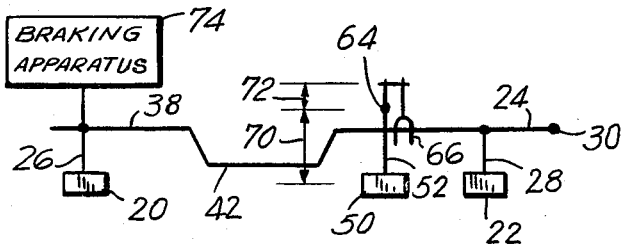

In accordance with the above, it will be noted that the support 30 indicated at the righthand side of FIG. 2A is so positioned relative to the pedals that pedal 20 is substantially further from support 30 than pedal 22 and so that pedal 50 is provided substantially closer to support 30 than pedal 20. In usual course of operation, pedal 20 would therefore have a substantially greater mechanical advantage than pedal 50, considering support 30 to be the fulcrum for the respective lever arms. However, this advantage to pedal 20 is overcome by the mechanical advantage afforded as between lever arms 70 and 72 with respet to pivot 64 whereby operation of pedal 50 will override operation of pedal 20 and prevent or reverse operation of the same as has been mentioned hereinabove.

Figure 2B:
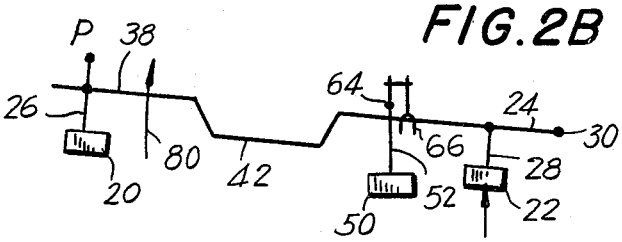

FIG. 2B illustrates that operation of pedals 20 or 22 will cause a swinging of the end 38 of rod 24 in the direction indicated by arrow 80. This will cause a pivoting of lever 26 about pivot P in such a manner as to operate the braking apparatus at 74. This movement is in accordance with the driver's ordinary displacement of the pedal so as to cause the pivoting of lever 26 about its pivot P in usual operating manner. This accommodation is permitted by the flexural characteristics of the rod 24 which permits this type of motion.

For the purpose of accommodating the above type of motion, the rod 24 is made sufficiently strong as to be able to impart a movement of pedal 20 by reason of operation of pedal 22, while at the same time being sufficiently flexural to admit of a displacement of deflection of the rod 20 so that its one end is held by support 30 while its other end 38 may move generally in the direction shown by arrow 80. To this end, the rod 24 is preferably made of steel, of, for example, a diameter of $\frac{1}{8}$ to $\frac{1}{2}$ of an inch, preferably centering about a quarter of an inch in diameter, although other dimensions and materials are readily possible in accordance with the invention. Thus, for example, the rod 24 may be made of other suitable materials such as alloys, synthetic plastics and the like.

Figure 2C:
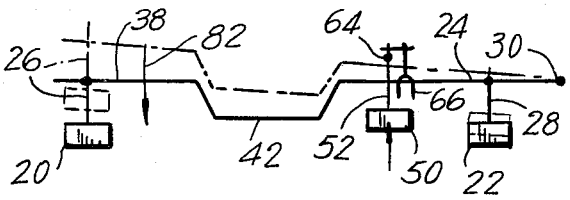

FIG. 2C illustrates that operation of the pedal 50 through the mechanical advantage discussed above will permit a reversing of the movement of the end 38 of rod 24, all as indicated by arrow 82, due to the mechanical advantages which have been described hereinabove. It will also be noted that the slotted member 66 is indicated in these figures, albeit only to indicate that the slotted member permits a detachable engagement with the rod 24, thereby permitting installation of the counter braking system of the invention after the dual control has been installed. This permits modification of already existing systems or facilitates the effecting of the initial installation of the counter control of the invention with respect to the initial modification of the educational driving vehicle which is to embody the safety improvements of the invention.

Figure 3:
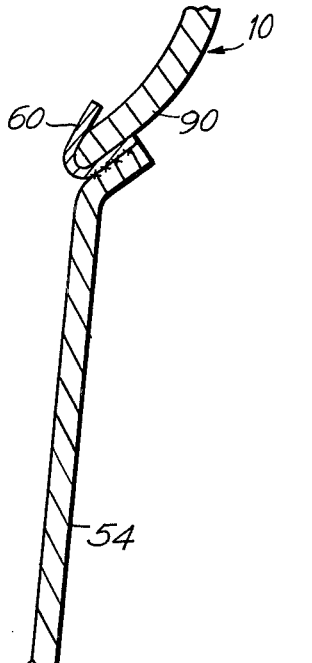
FIG. 3 is a sectional view taken along line 3—3 of FIG. 1.
Figure 3:
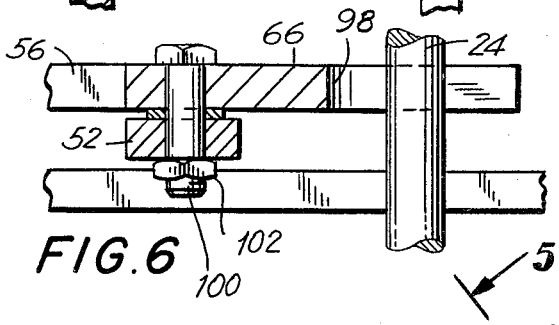

FIG. 3 is a further illustration of the construction of the invention, and in FIG. 3 will be seen the brace consisting of channel 56 with arm 54 angularly connected thereto. The fixed jaw 60 is also indicated as engaging with the lower extremity 90 of the dashboard 10 of the vehicle in which installation is effected. The fire wall of the vehicle is indicated again at 14, and extensible foot 62 is shown as being pivotably mounted on threaded member 92 engaging in section 94 of channel 56 and provided with a wing nut 96 to permit extension of the foot whereby to jam the bracing structure detachably in position.

Also illustrated in FIG. 3 is a pivot 62 on channel 56 supporting lever 52 and pedal 50. Member 66, provided with slot 104, is pivotably connected to lever 52 by pivot 100 having threaded ends whereby to provide for connection of nut elements 102.

It will be noted that rod 24 is accommodated in slot 98 and is also engaged in slot 104 (which is actually fitted in) in the end of lever 28 supporting pedal 22. Actually, the accommodation of rod 24 in slot 104 is not a sliding connection since the lever 28 is fixedly connected to rod 24 at this position by means of welding or the like so that the two elements are fixed together. It will therefore be appreciated that the pressing of the pedal 22 will displace the rod 24 substantially in the same manner as is effected by operation of pedal 20 (see FIG. 2B). There is no need, however, to consider mechanical advantages as between pedals 20 and 22 since these pedals operate in the same direction and thus do not oppose one another. It is therefore not as essential to consider mechanical advantages with respect to pedal 22 as is the case with pedal 50 since it is the pedal 50 alone which operates in opposition to the operation of pedal 20 as has been described hereinabove.

Figure 7:
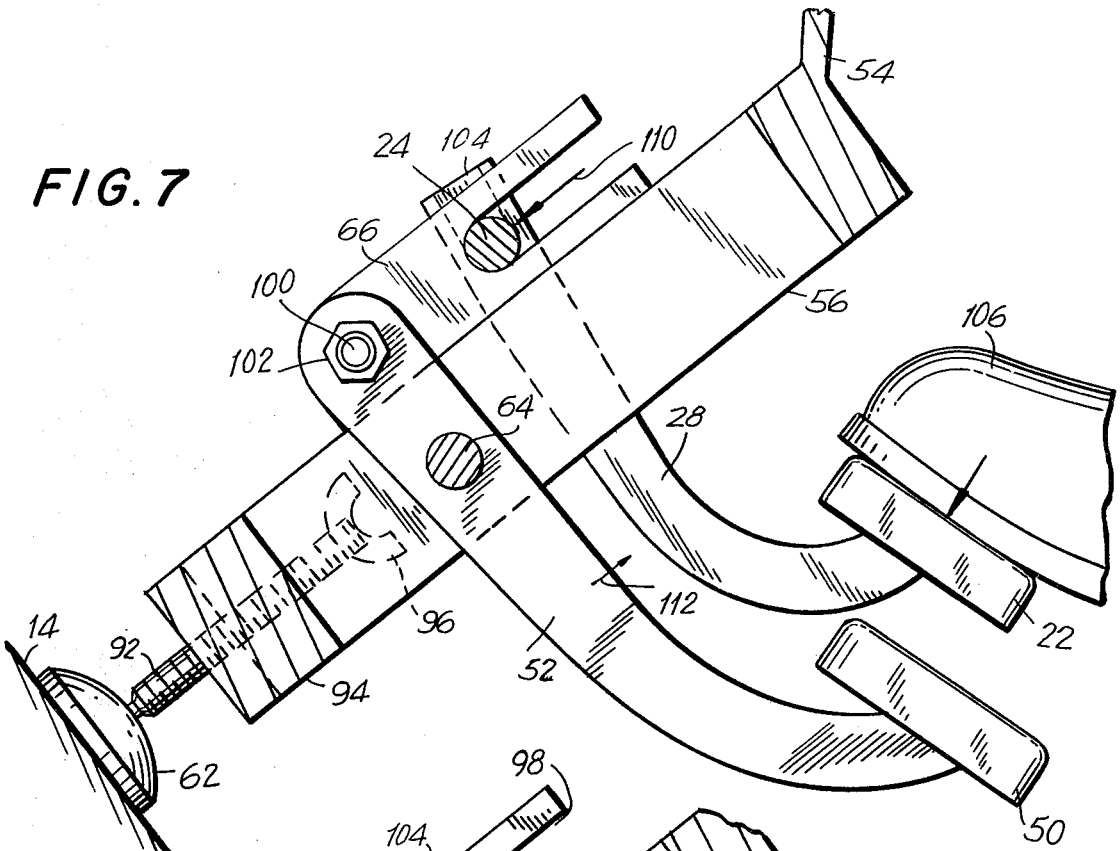
FIG. 7 is a side view of the counter braking system of the invention in one condition of operation.

FIG. 7 illustrates the operation of pedal 22 by the foot 106 of an operator (specifically, the passenger-teacher). It is shown that operation of pedal 22 is effective to displace rod 24 in the direction indicated by arrow 110. Displacement of rod 24 in the direction shown by arrow 110 is similar to the operation illustrated in FIG. 2B. This in turn will force the lever 52 to pivot in the direction illustrated by arrow 112, thereby enabling a cocking of the pedal 50. This is indicated merely as one feature of the invention since, while cocking of the pedal 50 may be particularly advantageous in some cases, it is not absolutely necessary in all construction arrangements of the invention.

Figure 8:
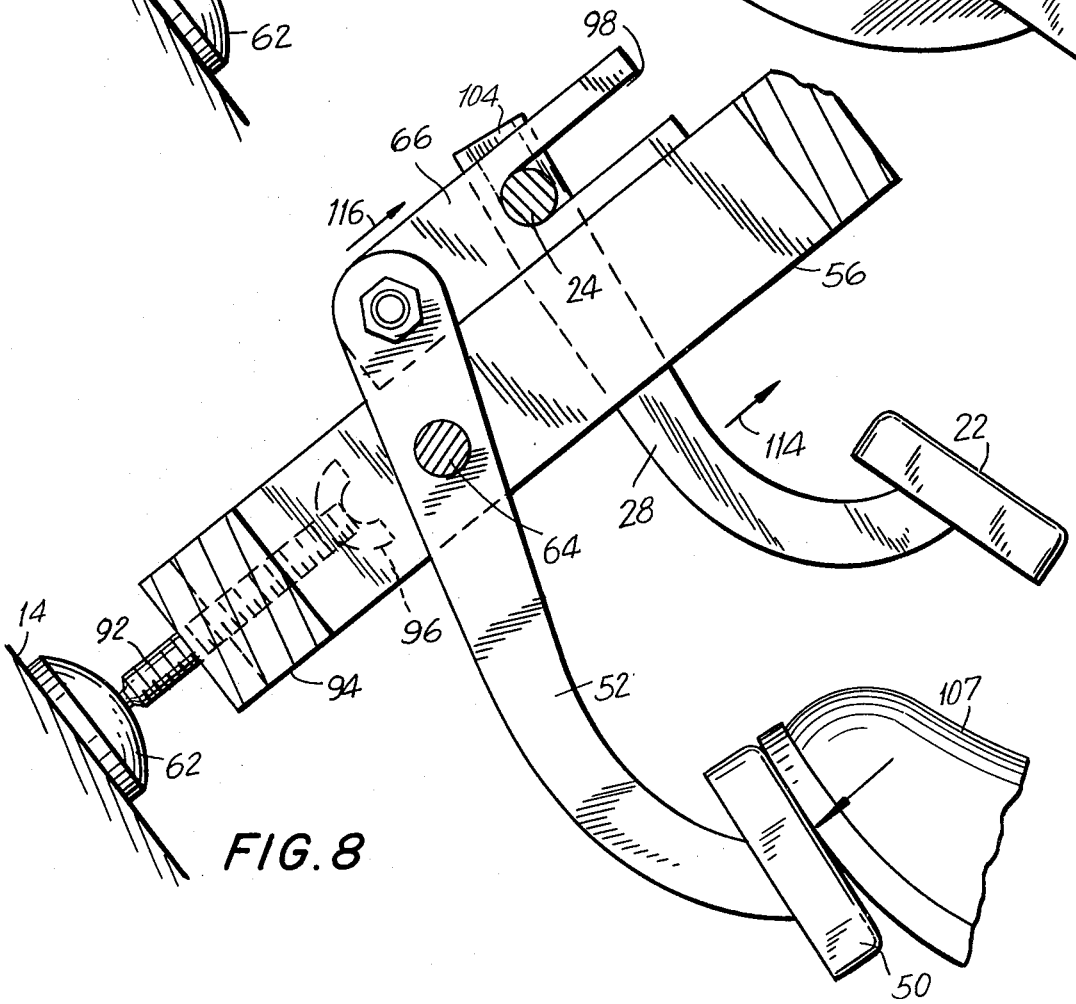
FIG. 8 is a view corresponding to FIG. 7, illustrating another condition of operation.

FIG. 8 illustrates operation of the pedal 50 by foot 107 of the passenger-teacher, thereby driving pedal 22 and lever 28 in the direction illustrated by arrow 114, this, in turn, being due to displacement of the member 66 in the direction indicated by arrow 116. Movement of lever 28 indicated by arrow 114 corresponds to the reversed motion indicated by arrow 82 in FIG. 2C, thereby providing for an operation by the passenger-teacher in such a manner as to prevent operation of the braking system or to reverse the operation thereof which would have otherwise been under the control of the driver-student. The mechanical advantages affording this possibility have been discussed hereinabove and are in the main due to the relative distances of pivot 100 from pivot 64 and the pedal 50 from pivot 64.

Figure 4:
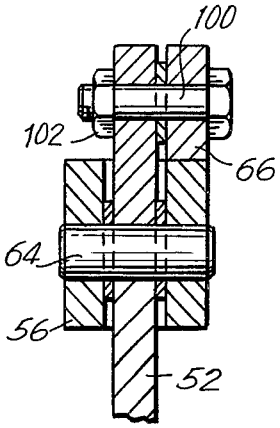
FIG. 4 is a sectional view taken along line 4—4 of FIG. 3.
Figure 5:
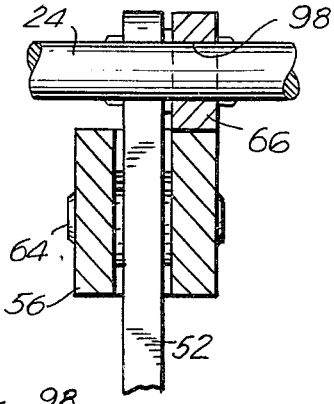
FIG. 5 is a sectional view taken along line 5—5 of FIG. 3.
Figure 6:
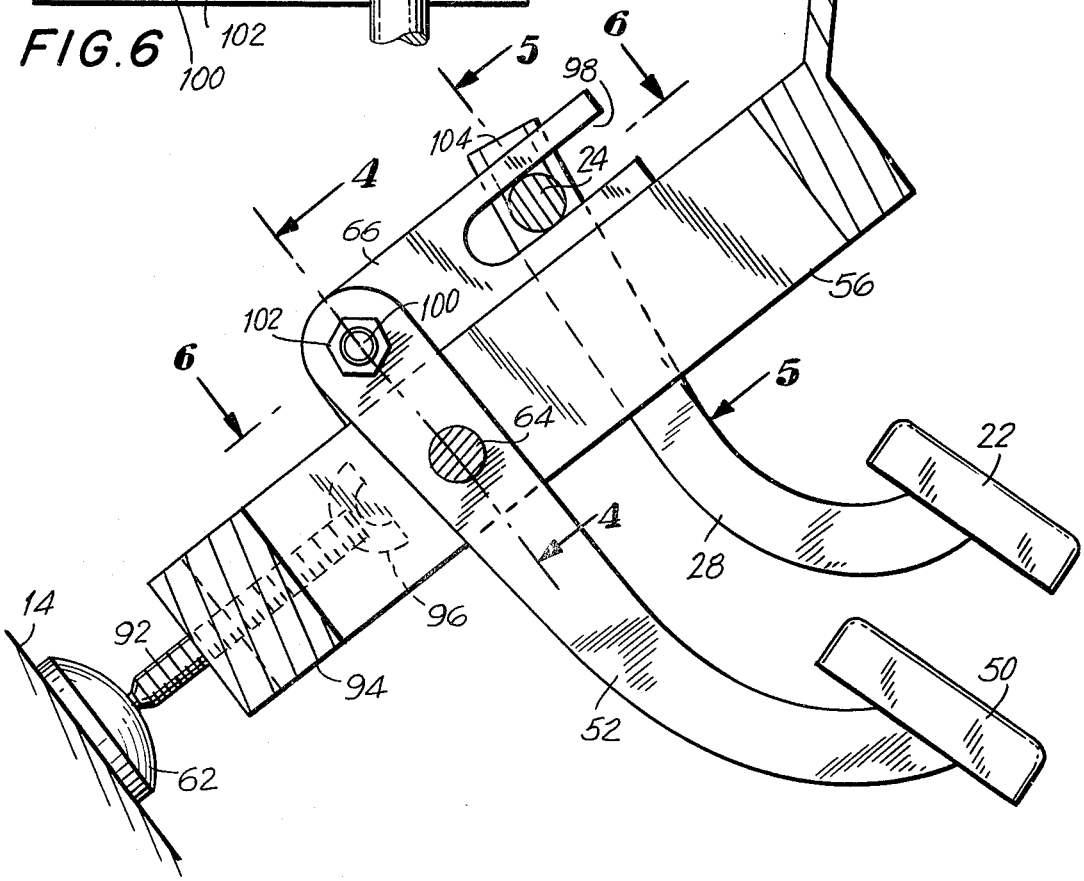
FIG. 6 is a sectional view taken along line 6—6 of FIG. 3.

The various relationships of the parts involved in the operation of pedal 50 are shown in FIGS. 4–6. Therein are shown pivots 64 and 100 operating in connection with lever 52 as well as the rod 24 accommodated in member 66. Brace channel 56 is also illustrated supporting the pivot 64, thereby rendering this pivot fixed relative to the vehicle or system in which the counter braking system of the invention is installed.

Figure 9:
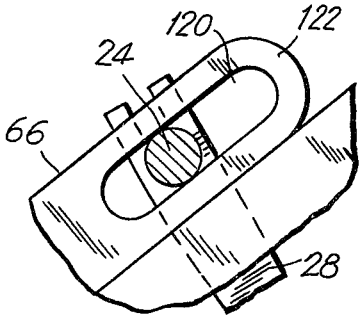
FIG. 9 illustrates a modification of the apparatus illustrated in FIGS. 7 and 8.

FIG. 9 illustrates a modification of the invention whereby the end of lever 66 is provided with a closed slot 20, being closed by end 122, as a consequence of which, the rod 24 is trapped therein. Lever 28 is also indicated in FIG. 9, thereby illustrating how this modification relates to the mechanical system which has been described hereinabove.

Figure 10:
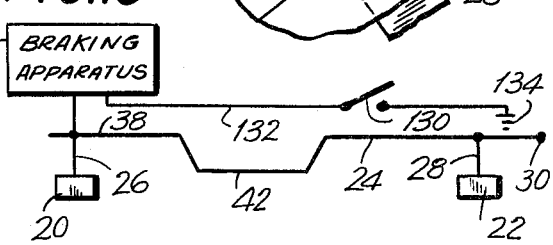
FIG. 10 diagrammatically illustrates further embodiments of the invention.

While the system described above has been substantially constituted by a mechanical system in entirety, FIG. 10 illustrates that the advantages of the invention may be provided generally in other ways as well. In FIG. 10 are illustrated pedals 20 and 22. This illustrated system does not include a pedal 50. Instead, the braking apparatus 74 is shown as being controlled by a switch 130 which may be coupled in an electrical or hydraulic line 132. If the line is electrical, the ground is shown by way of illustration at 134. The purpose of switch 130 is to enable the controlling of the hydraulic system or electrical system in turn overriding the operation of braking apparatus 74 by pedal 20. Thus, it is seen that the principles of the invention relate to the counter controlling of a braking apparatus or the like so that in a dual operator system, one operator or the other may control the functional system while one of these operators is provided with a counter control which prevents or overrides the operation of the system by the other of the operators.

From what has been stated above, it will now be clear that the invention contemplates a utility apparatus comprising at least one function means, first and second control means to control the operation of said function means respectively by first and second operators, and counter control means available to one of said operators to prevent the operation of said function means by the other of said operators.

There will now be obvious to those skilled in the art many modifications and variations of the constructions set forth hereinabove. These modifications and variations will not depart from the scope of the invention if defined by the following claims.

What is claimed is:

1. An educational driving vehicle with which a passenger-teacher instructs a driver-student to drive, said vehicle comprising driver-student braking means, passenger-teacher braking means to override the driver-student braking means to effect a braking of said vehicle, and counter braking means positioned for operation by the passenger-teacher to prevent or reverse the operation of the driver-student braking means by the driver-student, the passenger-teacher braking means and the counter braking means comprising adjacent pedals spaced from but coupled to the driver-student braking means, the driver-student braking means including a pedal coupled to the pedal of said passenger-teacher braking means, a support and a rod extending from said support, the pedal of said teacher braking means being coupled to said rod, the pedal of said driver-student braking means being coupled to said rod at a position further from said support than where the pedal of said passenger-teacher braking means is coupled to said rod, both said passenger-teacher braking means and driver-student braking means being adapted to deflect said rod in substantially the same direction, the counter braking means being detachably coupled to said rod and being adapted to deflect the rod in the direction generally opposite the first said direction.

2. A vehicle as claimed in claim 1 wherein the counter braking means includes means to fix the counter braking means in the vehicle by detachably bracing the same within the vehicle.

3. A vehicle as claimed in claim 2 wherein said means to fix the counter braking means includes a rigid structure including threadably extensible foot means.

4. A vehicle as claimed in claim 1 wherein said counter braking means includes a member provided with a slot in which to engage said rod.

5. A vehicle as claimed in claim 4 wherein the counter braking means includes a lever coupling the pedal of the counter braking means to said member.

6. A vehicle as claimed in claim 5 wherein the counter braking means includes a pivot supporting said lever in such a manner as to provide a mechanical advantage to the pedal coupled to said lever.

7. A vehicle as claimed in claim 6 wherein the member engages said rod at a position relative to said support such that the pedal of the driver-student braking means has a mechanical advantage which is less than that provided by said lever to said counter braking means.

8. A vehicle as claimed in claim 7 comprising spring means for spring loading said rod to a normal position of rest.

9. A vehicle as claimed in claim 1 wherein the driver-student braking means and counter braking means are so constructed and arranged as to have opposing mechanical advantages, said counter braking means including a system of levers connected so that the mechanical advantage of the counter braking means exceeds that of the driver-student braking means.

10. In a system having first and second controls selectively displaceable to effect a control operation and a connecting member interconnecting said controls whereby selective displacement of said second control is effective to displace said first control to effect said control operation, a counter control comprising a support, and a lever on said support to engage said connecting member and prevent displacement of said first control thereby to prevent said control operation, said lever including interconnected links constituting means so constructed and arranged as to provide a mechanical advantage to enable reversing displacement of said first control, said controls constituting means so connected and arranged on said connecting member that operation of said first or second controls displaces said counter control into position for operation thereof.

11. A counter control as claimed in claim 10 comprising a member pivoted to said lever and provided with a slot said connecting member is engaged in said slot.

12. A counter control as claimed in claim 11 wherein said connecting member is a rod and said controls include pedals connected to said rod at spaced positions, said counter control including a pedal positioned substantially closer to said second control than to said first control.

13. A counter control as claimed in claim 12 comprising means supporting said rod adjacent said second control.

14. A counter control as claimed in claim 13 wherein said support includes connected relatively extensible parts whereby the support can be detachably jammed into position for the support of said lever.

15. A counter control as claimed in claim 14 comprising a fixed claw on at least one of said parts to grasp onto said system.

16. A counter control as claimed in claim 14 comprising a pivot on said support supporting the pedal of said counter control and means coupled to the latter said pedal for engaging and displacing said rod.

* * * * *